US005364018A

United States Patent [19]

Carlsson

[11] Patent Number: 5,364,018

[45] Date of Patent: Nov. 15, 1994

[54] DISPOSABLE PACKAGE

[75] Inventor: Ingmar Carlsson, Sundbyberg, Sweden

[73] Assignee: Eson Pac AB, Veddige, Sweden

[21] Appl. No.: 66,019

[22] PCT Filed: Sep. 20, 1992

[86] PCT No.: PCT/SE91/00677

§ 371 Date: Jul. 16, 1992

§ 102(e) Date: Jul. 16, 1992

[87] PCT Pub. No.: WO92/09487

PCT Pub. Date: Jun. 11, 1992

[30] Foreign Application Priority Data

Nov. 27, 1990 [SE] Sweden ..... 90 03778-9

[51] Int. Cl.[5] ..... B65D 5/20; B65D 5/46; B65D 5/48

[52] U.S. Cl. ..... 229/120.17; 229/114; 229/117.24; 229/120.09; 229/901; 229/906

[58] Field of Search ..... 229/114, 2.5 R, 117.19, 229/117.24, 120.08, 120.09, 120.17, 120.01, 901, 902, 906, 240, 243

[56] References Cited

U.S. PATENT DOCUMENTS

| | | | |
|---|---|---|---|
| 3,124,293 | 3/1964 | Transport | 229/114 |
| 3,463,379 | 8/1969 | Dlugopolski | 229/117.24 |
| 3,876,132 | 4/1975 | Kuchenbecker | 229/27 |
| 4,183,446 | 1/1980 | Davis | 229/2.5 R |
| 4,226,358 | 10/1980 | Ottow | 229/120.09 |
| 4,232,816 | 11/1980 | Johnson et al. | 229/114 |
| 4,470,538 | 9/1984 | Heathcock et al. | 229/23 R |
| 4,694,987 | 9/1987 | Forbes, Jr. | 229/114 |
| 4,705,173 | 11/1987 | Forbes, Jr. | 206/563 |
| 4,848,648 | 7/1989 | Eisman | 229/114 |
| 4,944,451 | 7/1990 | Forbes, Jr. | 229/120.17 |
| 5,039,003 | 8/1991 | Gordon et al. | 229/114 |

FOREIGN PATENT DOCUMENTS 0324682 7/1989 European Pat. Off. .

*Primary Examiner*—Gary E. Elkins

*Attorney, Agent, or Firm*—Jacobson, Price, Holman & Stern

[57] ABSTRACT

A disposable package for fast food has two bowl-shaped sections which are interconnected along the common edge of a pair of adjacent end walls. The opposite end walls have tabs defining male and female connectors whereby the sections can be joined when folded together. Also, the side walls of at least one of the sections is provided with fold-in tabs which can be used to grip an item of food contained within the package.

3 Claims, 2 Drawing Sheets

DISPOSABLE PACKAGE

BACKGROUND OF THE INVENTION

The present invention relates to a disposable package, designed particularly for fast food, such as hamburgers with french fries.

Whenever possible packages of this kind should be manufactured from paper, cardboard, corrugated board, porous cellulose or any other material which is easily decomposed, i.e. compostable. Further, the material should be a porous material or a material with several layers with air spaces in between. In some cases the package should be provided with a lid, and in certain cases divided up into two sections, if a sauce, french fries or similar items are served with the fast food. In addition, the package must readily facilitate easy eating of its contents and prevent spillage.

Several varieties of containers or packages of this kind have been proposed for the above mentioned purposes, resulting in major storage requirements for packages and adding to the cost of handling.

SUMMARY OF THE INVENTION

The objective of the invention is to provide a disposable package which meets all the above demands, so that it is necessary to store only one single type of package, and one which is, particularly suited for eating from.

A disposable package, particularly for fast food, such as hamburgers with french fries, is provided comprising two deep bowl-shaped sections which are interconnected along a common edge line and have each an outer edge line of one package wall, parallel to the common edge line, which outer edge lines, together with the common edge line and intermediate, uppermost, essentially longer side edges of the longitudinal walls of the package sections are disposed essentially in one and the same plane. According to the present invention the two bowl-shaped sections are foldable along the common edge line, and the two package walls, which are defined by the said outer edge lines, are extended upwards by means of flaps or tongues which form a coupling pair, e.g. of the male and female type, so that both bowl-shaped sections, when folded together, may be locked by means of the coupling pair or, when needed, an additional disposable package of an identical type, disposed upside down, may be placed on the package, and connected thereto by means of the coupling pairs.

According to the invention it is preferable that the longitudinal sides of at least one of the package sections are provided with two slots and/or tearing lines that extend from the uppermost side edges and along the major portion of the height of the side walls at a distance from each other of at least two to three thumb widths.

The two slots and/or tearing lines of each one of the said longitudinal walls are designed to define a tearing flap, preferably tapering downward.

BRIEF DESCRIPTION OF THE DRAWINGS

The invention and the advantages attained thereby are illustrated in more detail below with reference to the accompanying drawings, which diagramatically show one embodiment of the invention, picked as an example, and wherein FIG. 2 is a frontal view of the same package, completed by a further, identical package, turned upside down, applied as a lid; whereas

DESCRIPTION OF PREFERRED EMBODIMENTS

Figure 1:
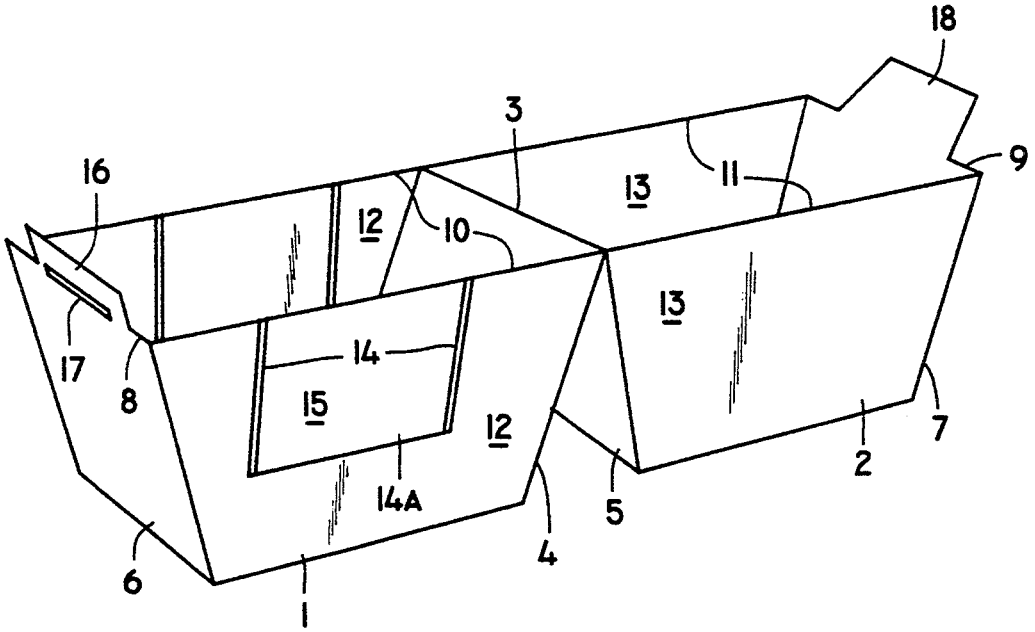
FIG. 1 is a perspective view of the disposable package, intended to be used for a hamburger with french fries.

FIG. 1 shows the disposable package, which is made from very finely dimensioned corrugated cardboard with a bowl-shaped container section 1 for a hamburger and another equally large bowl-shaped container section 2 for french fries. The two sections 1 and 2 of the package are integrated along a common edge line 3, which constitutes an uppermost boundary for one of the end walls 4, 5, of each package section 1, 2. The other end walls 6, 7 of the package sections are defined upwardly by an edge line 8 and 9, respectively, which, with the package standing on a flat support, are in flush with each other and with the uppermost ledge line 3 as well as with the uppermost edge lines 10 and 11, respectively, of the longitudinal walls 12 and 13, respectively, of the package sections 1, 2.

The longitudinal walls 12 of the package section 1 are each provided with two slots and/or tearing lines 14, which extend from the edge lines 10 along a little more than half the height of the side wall 12 in question, but not downward on the side walls to the extent that the stiffness of the package 1 becomes unduly reduced. The slots 14 are mutually and have a mutual spacing of two to three ordinary thumb widths for reasons explained below. If desired, the slots 14 may converge slightly downwards.

The purpose of the slots 14 and the flaps 15 formed thereby is that it should be possible while eating, to clamp a hamburger in the package section 1 and protruding above the edge lines 10 of the package section to about half of its height, with the thumb and fingers pressing against the outer surfaces of the flaps 15. When the first half of the hamburger has been eaten it is intended that the flaps 15 should be folded out and, if desired, be torn off along tearing lines 14*a*, so as to expose the major section of the remainder of the hamburger within the package section 1. While the hamburger is being eaten, the french fries are kept in the package section 2, i.e. both of the package sections 1, 2 are held by one hand, so that the other hand is always remains free.

If the content of the package 1, 2 is to be consumed immediately on the premises, the package as shown in FIG. 1 is sufficient. If, however, the food is to be carried away from the premises, it will be necessary to provide the package with a lid. To this end, the end wall 6 of the package section 1 is slightly extended upwards, above the edge line 8, by means of a standing flap 16 which is provided with a slot 17 in level with the edge line 8. Further, the end wall 7 of the package section 2 is provided with an upward tapering tongue 18 which protrudes upwardly above the edge line 9 and which has a maximum width corresponding to the length of slot 17.

Figure 2:
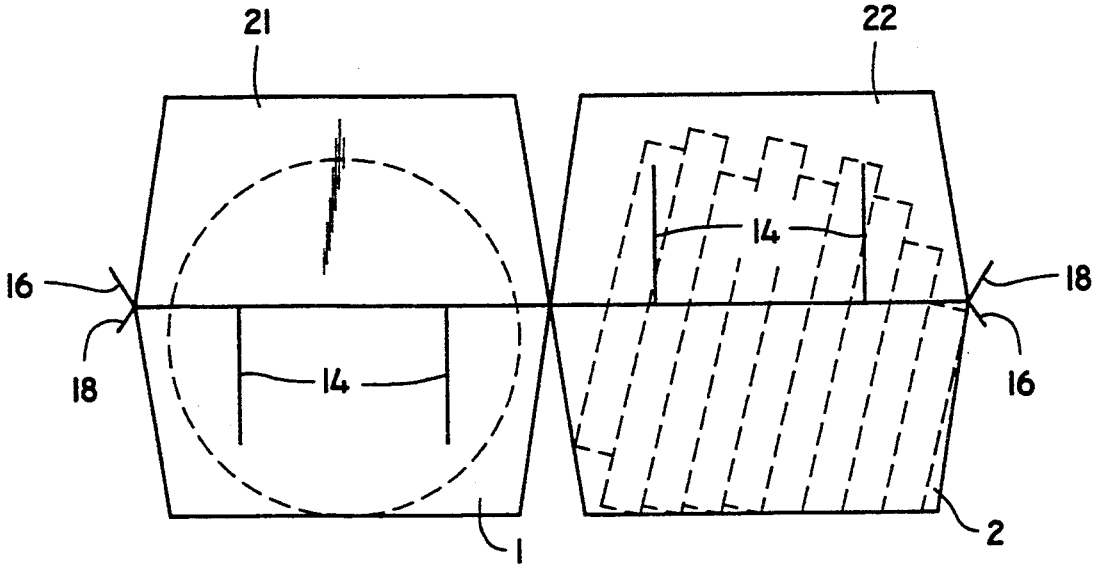

This design of the package 1, 2 permits use of a second package 1, 2 turned upside down in the form of a lid with the tongue of the second package protruding into the slot 17 of the package 1, 2 and resting against the flap 16, and with the tongue of the package 1, 2 protruding into the slot of the second package, resting against the flap that protrudes upwardly from the slot, as shown in FIG. 2, wherein the two sections of the second package have been denoted 21 and 22, respectively. The illustrated interconnection of the two packages, when a lid is required, has been chosen as a simple example. As is evident, several other feasible solutions, also based on snap action, are available.

If only hamburger or similar item is fetched and carried away, then this may of course be placed within the package section 1, and the package section 2 may be folded over the package section 1 to serve as a lid, and locked in position by means of the tongue 18 and the slot 17, since these will automatically fit together. This applies also if the package 1, 2 is provided with any other type of coupling pair, such as the male-female type.

Figure 3:
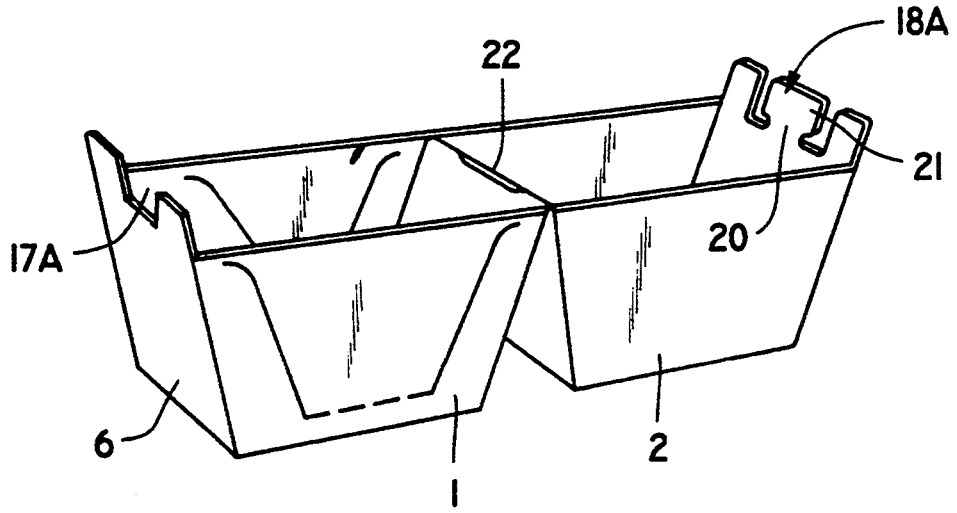
FIG. 3 is a perspective view, resembling FIG. 1 but illustrating a slightly modified embodiment, and wherein, finally.
Figure 4:
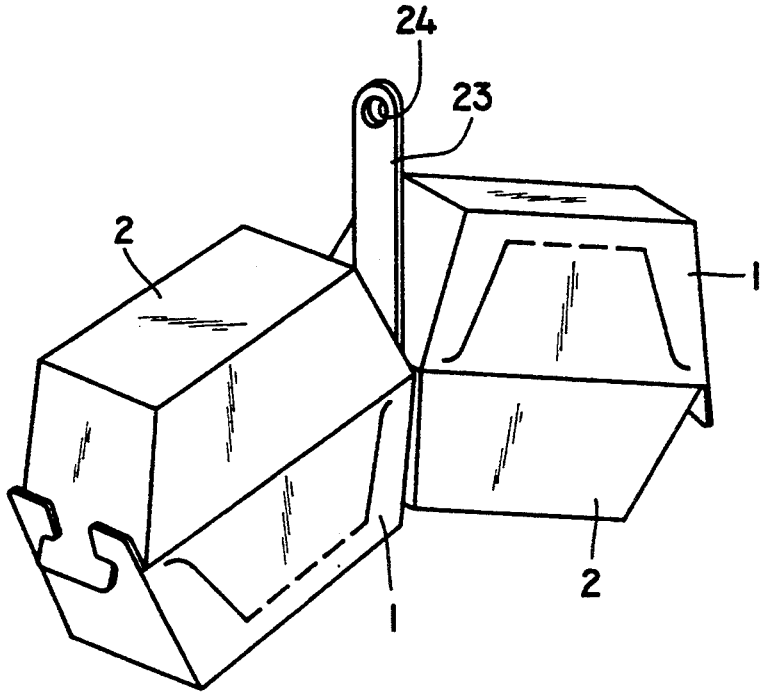
FIG. 4 is a perspective view of the disposable package of FIG. 3, completed by a further, identical package, turned upside down, applied as a lid, and completed with a carrier device.

In the embodiment in FIGS. 3 and 4 the coupling tongue 18A of the package section 2 is designed with a neck 20 and a head 21 for locking with a suitably designed slot 17*a* in the end wall 6 of the package section 1.

Further, each disposable package 1, 2 has at the joint between the package sections 1, 2 a slot 22, FIG. 3, to receive a suitably designed carrier device 23, e.g. a cardboard strip with a grip hole 24.

Of course, the invention is by no means restricted to the embodiment shown, but can be modified in several ways within the scope of the invention as defined in the claims.

I claim:

1. A disposable package comprising two deep bowl-shaped sections having an adjacent pair of end walls with a common edge along which the sections are interconnected, the sections further having opposite end walls and side walls each with an edge in a plane containing said common edge, the package being foldable along said common edge to bring the sections together, the opposite end walls having outwardly extending tongues providing respective male and female connectors for securing the sections when brought together and for attachment thereon of another identical upside down package when the sections are opened out, wherein the side walls of at least one of the package sections are each provided with a pair of spaced separation lines extending downwardly from the edge of the respective side wall to define a fold-in flap therebetween.

2. A package as defined in claim 1, wherein the separation lines comprise respective slots.

3. A package as defined in claim 1, wherein the separation lines comprise respective tear lines.

* * * * *